United States Patent [19]

Pendell

[11] 4,114,218

[45] * Sep. 19, 1978

[54] METHOD OF FORMING FLAT FOUR-SIDED FASTENER PARTS HAVING AN OPENING THEREIN

[76] Inventor: Larry Stuart Pendell, Rte. 8, Box 489, Elkhart, Ind. 46514

[ * ] Notice: The portion of the term of this patent subsequent to May 24, 1994, has been disclaimed.

[21] Appl. No.: 799,705

[22] Filed: May 23, 1977

[51] Int. Cl.[2] ..... B21D 53/20; B21D 53/24

[52] U.S. Cl. ..... 10/86 R; 10/86 B; 29/412; 83/42

[58] Field of Search ..... 10/73, 75, 86 R, 86 A, 10/86 B, 86 F; 29/412, 415, 417; 83/32, 40, 42, 46, 48, 56, 405, 406; 85/32 R; 113/116 V, 116 Y, 116 BB

[56] References Cited

U.S. PATENT DOCUMENTS

| | | | |
|---|---|---|---|
| 2,371,440 | 3/1945 | Hall | 10/86 R |
| 2,707,012 | 4/1955 | Cox | 10/86 B |
| 4,024,593 | 5/1977 | Pendell | 10/86 R |

*Primary Examiner*—E. M. Combs

[57] ABSTRACT

A method of forming flat four-sided fastener parts from an elongated strip of sheet material by causing the material to progressively pass through a work station where a series of longitudinally spaced openings are formed in the material, and thereafter the material is periodically severed along an irregular line extending from one side to the other of the sheet material for the purpose of separating individual fastener parts from the material.

4 Claims, 11 Drawing Figures

Fig.11
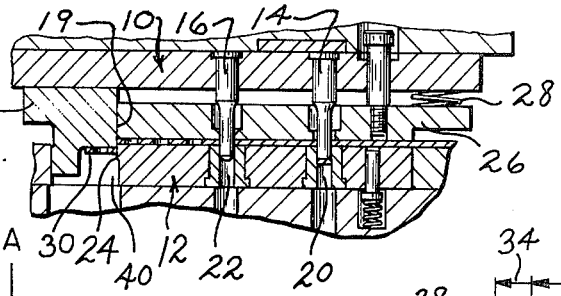
Fig.1
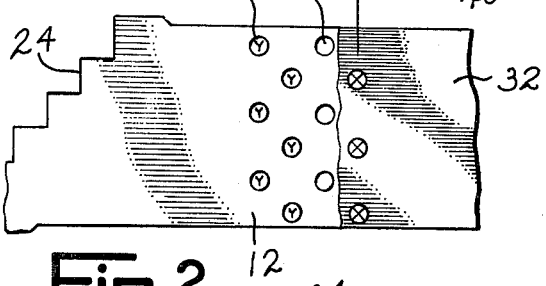
Fig.6
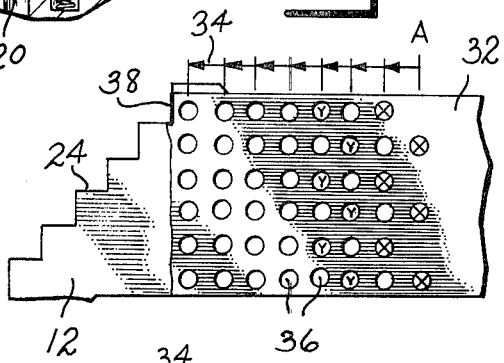
Fig.2
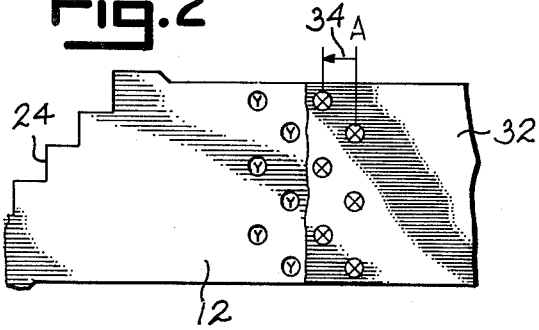
Fig.7
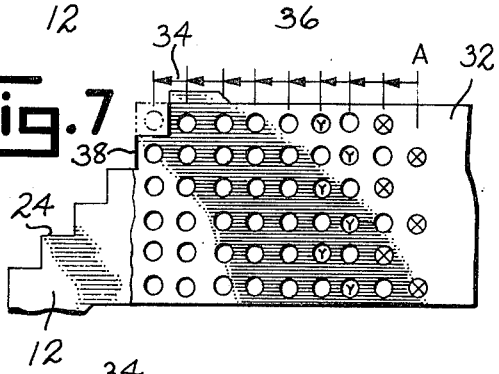
Fig.3
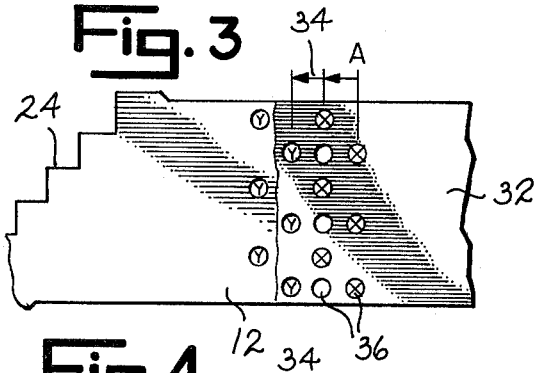
Fig.8
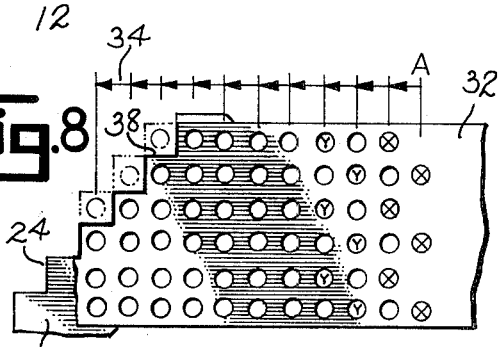
Fig.4
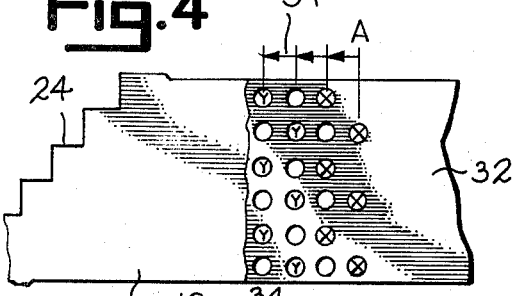
Fig.9
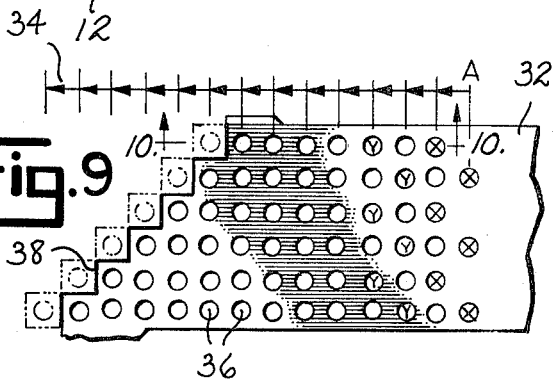
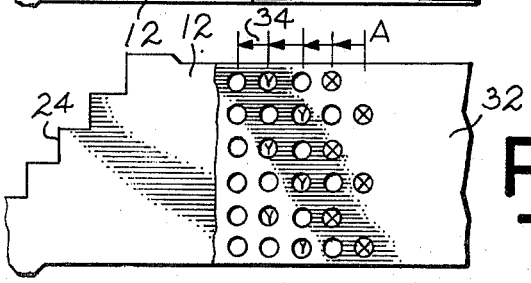
Fig.5
Fig.10
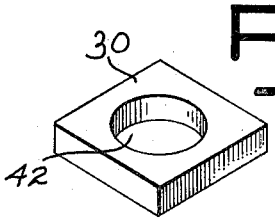

METHOD OF FORMING FLAT FOUR-SIDED FASTENER PARTS HAVING AN OPENING THEREIN

CROSS-REFERENCE TO RELATED APPLICATION

The following described invention is related to my co-pending patent application Ser. No. 687,764, filed May 19, 1976, U.S. Pat. No. 4,024,593 entitled "A Method of Forming Flat, Multiple-Sided Fastener Parts Having An Opening Therein."

SUMMARY OF THE INVENTION

This invention relates to a method of forming flat, four-sided fastener parts, such as washers and nuts, having a center opening therein.

An elongated strip of sheet material is progressively fed through a work station where a series of longitudinally spaced openings are formed in the material. As the material passes through the work station it is severed from one side edge to the other side edge along an irregular line defining contiguous multiple sides of adjacent fastener parts. This separates individual fastener parts from the adjacent parts, with at least one of the individual fastener parts being separated along the cutting line from the adjacent parts along two of its adjoining sides. In this manner, as each fastener part is severed from the sheet material, at least one and a maximum of two side edges of other adjacent parts are formed in the sheet material to reduce to a minimum the waste material produced in forming the fastener parts. If desired, a threading step in the process after the sheet material has been punched but before the individual fastener parts are severed from the material can be included so that nuts may be economically produced from the sheet material.

Accordingly, it is an object of this invention to provide a method of forming fastener parts having four sides and an opening therein.

Another object of this invention is to provide an economical method of forming square-shaped washers or nuts.

Other objects of this invention will become apparent upon a reading of the invention's description.

BRIEF DESCRIPTION OF THE DRAWINGS

FIGS. 1–9 are sequential top plan views showing a strip of sheet material being formed into square-shaped washers by progressive steps.

FIG. 10 is a perspective view of a washer formed in accordance with the method of this invention.

FIG. 11 is a fragmentary sectional view of the dies of a press taken along line 10—10 of FIG. 9 and illustrating the method of this invention.

DESCRIPTION OF THE PREFERRED EMBODIMENT

The preferred embodiment illustrated is not intended to be exhaustive or to limit the invention to the precise form disclosed. It has been chosen and described in order to best explain the principles of the invention and its application and practical use to thereby enable others skilled in the art to best utilize the invention.

The method of this invention may be performed upon a common reciprocating press having an upper die 10 which is mounted to the die slide and a lower die 12 which is mounted to the press bolster. The press to which dies 10 and 12 are connected may be of the ordinary reciprocating type having a ram which shifts upper die 10 relative to lower die 12 in the customary manner. The term "forward" and similar directional terms used in the description of this invention have relationship to the travel of the sheet material between dies 10 and 12, with the term "forward" referring to the direction of travel of the material along its pass line between the dies.

Upper die 10 includes a plurality of depending punches 14 (only one shown) and a plurality of depending locating pins 16 (only one shown). Upper die 10 also includes a knife part 18 which extends from one side to the other side of the pass line of the sheet material between the dies. Knife part 18 has a diagonal, stepped cutting edge 19 formed by a series of adjoining right angular shoulders.

Lower die 12 includes a plurality of openings 20 and 22 which receive punches 14 and pins 16 respectively as upper die 10 is lowered with its knife part 18 complementally overlapping the cutting edge 24 of the lower die. As is customary, upper die 10 includes a shiftable stripper plate 26 which upon expansion of suitable springs 28 (only one shown) will be urged away from the lower face of the upper die for the purpose of holding the sheet material against the upper face of lower die 12 as punches 14 of the upper die and its knife part 18 are withdrawn from the sheet material upon a raising of the upper die.

A description of the method of forming four-sided washer parts such as washer 30 shown in FIG. 10 using the above described apparatus follows. An elongated piece of sheet material 32, which is generally of a rolled steel composition but which may be of a plastic, rubber or other suitable material, is progressively fed in increments through the press between its upper die 10 and its lower die 12 by a suitable commercially available feed mechanism. An illustration of the advancement of the sheet material 32 and the formation of washers 30 is seen in FIGS. 1–9 which are numbered in sequential order. This progressive movement of sheet material 32 is indicated by arrows 34. To assist in the understanding of the method of this invention, a reference line A is shown in each of the FIGS. 1–9, with the incremental advancement of material 32 in the direction of arrows 34 being indicated as shown. As material 32 passes forwardly between dies 10 and 12 over openings 20 and 22 in the lower die, a plurality of openings 36 are formed by punches 14 in the material. As the material, now having openings 36 formed in it, passes over lower cutting edge 24 of die 12, a diagonal progressively stepped cut 38 is formed across the material by knife part 18 of upper die 10 as seen in FIGS. 6–9. To form the illustrated square-shaped washers 30, the cutting edge 19 of knife part 18 extends at a 45° angle to the material pass line with the adjoining right angular knife part shoulders being of equal dimension except for the shoulders of the extreme ends of the knife part which are slightly longer so as to project beyond the material side edges.

With the progressive advancement of sheet material 32 along its pass line between dies 10 and 12 and the coordinated reciprocating cutting movement of knife 18 of upper die 10, sheet material 32 is severed diagonally with a plurality of individual washers 30 being separated from the material each, with the exception of one such washer, along two of its adjoining side edges. The separated washers then fall through an opening 40 in lower die 12 and into a suitable receptacle.

It will be observed that as individual washers 30 are severed from sheet material 32, each washer, except one, in the next series of washers to be separated from sheet material 32 has two of its adjoining sides formed. By producing four-sided washers the formation of waste scrap material from sheet material 32 is all but eliminated, with the exception of that material created during the formation of openings 42 in the washers.

If the four-sided fastener device is to be a nut instead of the washer illustrated in the drawings, an intermediate threading step in the process may be introduced between the blanking operation in which the opening in the nut is formed and the severing operation in which the nuts are separated from the sheet material.

It is to be understood that the invention is not to be limited to the details above given, but may be modified within the scope of the appended claims.

What I claim is:

1. A method of forming flat, square-shaped individual fastener parts each having an opening therein from an elongated strip of sheet material having a width exceeding the width of each such fastener, comprising the steps of:

(a) causing said material to pass progressively through a work station;

(b) first forming a series of longitudinally spaced openings in the material as it passes through said work station; and then (c) periodically severing said material as the material passes through the work station from one side edge to the other side edge of the material in one cutting operation along an irregular cutting line defining contiguous multiple sides of adjacent fastener parts to separate individual fastener parts from said adjacent parts, at least one of said individual fastener parts being separated along said cutting line from such adjacent parts along two of its adjoining sides.

2. The method of claim 1 wherein the step of severing said material includes cutting said material diagonally in a sawtooth line extending at substantially a 45° angle across the material.

3. The method of claim 1 including the step of threading said openings in said sheet material prior to severing said material into individual fastener parts to form four-sided nut type fastener parts.

4. The method of claim 1 wherein step (c) includes separating three or more individual fastener parts from said adjacent parts with each individual fastener part except one such part being separated along said cutting line from said adjacent parts along two its adjoining sides.

* * * * *